United States Patent [19]

Benson

[11] 4,294,079

[45] Oct. 13, 1981

[54] INSULATED CONTAINER AND PROCESS FOR SHIPPING PERISHABLES

[75] Inventor: Ernest J. Benson, Berkeley Heights, N.J.

[73] Assignee: Better Agricultural Goals Corporation, Dallas, Tex.

[21] Appl. No.: 129,565

[22] Filed: Mar. 12, 1980

[51] Int. Cl.[3] ..... B65B 63/08; F25D 3/08

[52] U.S. Cl. ..... 62/60; 62/372; 62/388; 62/457

[58] Field of Search ..... 62/60, 372, 384, 388, 62/457, 529, 530

[56] References Cited

U.S. PATENT DOCUMENTS

| | | | |
|---|---|---|---|
| 1,713,348 | 5/1929 | O'Brien | 62/372 |
| 1,735,082 | 11/1929 | Martin, Jr. | 62/60 |
| 1,786,161 | 12/1930 | Jones et al. | 62/60 X |
| 1,843,038 | 1/1932 | McIlvain | 62/372 X |
| 1,963,743 | 6/1934 | Hoodless | 62/372 |
| 1,980,089 | 11/1934 | Rice, Jr. | 62/388 X |
| 1,998,681 | 4/1935 | Littleford, Jr. | 62/372 X |
| 2,049,779 | 8/1936 | Routh | 62/60 X |
| 2,149,412 | 3/1939 | Bangs | 62/60 |
| 2,216,330 | 10/1940 | Stover | 62/372 |
| 2,236,052 | 3/1941 | Berger | 27/23 |
| 2,289,060 | 7/1942 | Merkle | 62/60 X |
| 2,302,639 | 11/1942 | Moore | 62/372 X |
| 2,467,268 | 4/1949 | Merkle | 62/372 |
| 2,631,439 | 3/1953 | Feigenbaum | 62/372 |
| 2,915,235 | 12/1959 | Rueckert | 62/372 X |
| 3,864,936 | 2/1975 | Frank et al. | 62/385 |
| 4,065,336 | 12/1977 | Conklin | 62/372 X |

*Primary Examiner*—Lloyd L. King

*Attorney, Agent, or Firm*—Richards, Harris & Medlock

[57] ABSTRACT

An insulated container (10) and a process for shipping perishable products utilizes a box (16) having a lid (18) with an internal compartment for receiving a quantity of dry ice (32) or other expendable refrigerant. The perishable products, which are prechilled, are packed into the box (16) and are covered with a layer of wet ice (24) and a wet pad (26). As the dry ice (32) sublimates, it freezes the wet pad (26) and refrigerates the box (16) to maintain the products in chilled condition. Secondary refrigeration is provided by the frozen wet pad (26) and layer of ice (24).

20 Claims, 2 Drawing Figures

INSULATED CONTAINER AND PROCESS FOR SHIPPING PERISHABLES

TECHNICAL FIELD

The present invention relates generally to an apparatus and method for shipping perishables. More particularly, this invention is directed to an insulated shipping container and process for shipping chilled seafood, meat and other perishable products.

BACKGROUND ART

Food products and other perishables are typically chilled either before, during or after processing to reduce bacterial growth and to retard onset of product spoilage. Ideally, food products such as seafood, meat and fish should be chilled to a temperature near but not at or below their freezing point to retain freshness. Such products must be shipped under chilled conditions in refrigerated or insulated containers containers in order to achieve sufficient shelf life and thus reduce waste during distribution.

Shipping cost is often the determinative factor in distribution to various markets of products tending to spoil rapidly if not shipped under chilled conditions which can be controlled within a relatively narrow temperature range. Refrigerated containers provide the desired temperature control but are usually heavy, bulky and expensive to operate. Moreover, since refrigerated shipping containers are usually transported by truck, rail or ship, these relatively slow modes of transportation serve to limit the area of distribution of such products. On the other hand, while insulated shipping containers are generally less bulky and thus more suitable for air transport than refrigerated containers, the insulated containers of the prior art have not provided the kind of temperature control necessary for shipping fresh seafood, meat and the like over extended periods of time. The end result has been either gradual rise to a undesireably high temperature or freezing of the fresh product within the container.

Although several insulated shipping containers have been developed heretofore, various difficulties have been associated with the apparatus and methods of the prior art. Difficulties with the prior insulated shipping containers have centered around their low product load/container weight ratios and inability to sustain chilled temperatures for sufficient duration. Moreover, the insulated shipping containers of the prior art have been relatively costly by reason of complicated construction, little or no reusability, and the requirement for special handling techniques and procedures when utilizing such containers. In general, the insulated shipping containers of the prior art have been too expensive and uneconomical for one time use. Return freight costs for nonreuseable containers can be substantial.

Various approaches have been taken to the problem of maintaining the proper product temperature within an insulated shipping container, including the use of dry ice or solid carbon dioxide as shown in U.S. Pat. Nos. 3,864,936, 2,236,052, 2,302,639, 2,915,235 and 1,998,681; however, the shipping containers and techniques of the prior art have been unsatisfactory for one reason or another.

A need has thus arisen for an improved process and container for shipping chilled perishables with greater efficiency.

DISCLOSURE OF THE INVENTION

The present invention comprises an apparatus and method for shipping perishables which overcomes the foregoing and other difficulties associated with the prior art. In accordance with the invention, there is provided a novel shipping container of lightweight, insulated construction for shipping perishables such as fresh seafood and meat under chilled or frozen conditions for extended periods of time. The shipping container of the invention is reusable and inexpensively constructed, and is particularly adapted for airfreight shipment of perishables. The container and process of the invention utilizes two different expendible refrigerants to maintain temperature control of the products being shipped.

More specifically, the present invention comprises a new and useful insulated container and process for maintaining temperature control of chilled perishables during shipment. The invention is particularly adapted for airfreight shipment of products like seafood, poultry and meat which would spoil rapidly unless maintained under controlled chilled conditions. The product to be shipped is initially chilled to a temperature just above the freezing point of the product before loading into the insulated container. A layer of ice is then spread over the product, followed by a pad of absorbent material saturated with water. The insulated container is closed with a lid which includes a compartment for receiving dry ice which sublimates and passes through perforations in the lid to freeze the wet pad and provide primary refrigeration for the products in the container. Secondary refrigeration is provided by the frozen wet pad which functions as a cold sump. Final refrigeration is provided by the wet ice and, to some extent by the chilled product itself, after the dry ice has completely sublimated and the wet pad and ice have thawed.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
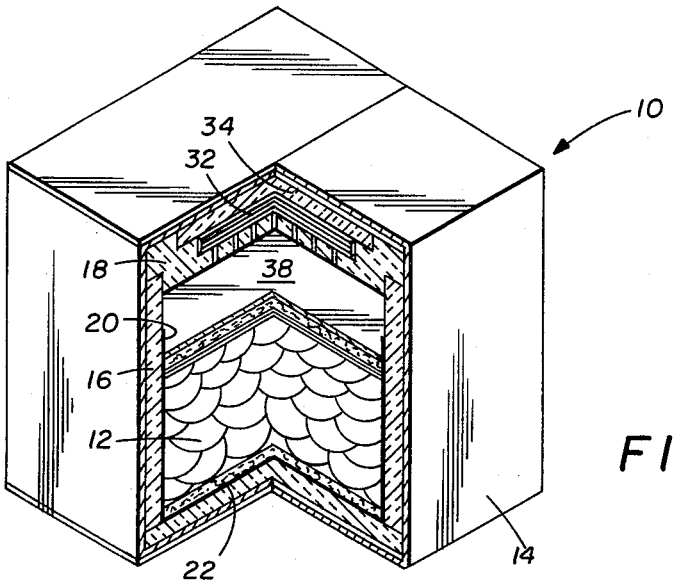
FIG. 1 is a perspective view of a shipping container according to the invention with a quarter section broken away.

Referring now to the Drawings, wherein like reference numerals designate like or corresponding parts throughout the views, and particularly referring to FIG. 1, there is shown an insulated container 10 according to the invention for shipping chilled products 12. For example, products 12 can comprise fresh seafood, red meat, poultry, fruit and other perishables which must be chilled and maintained under refrigerated conditions during shipping and distribution. Unfrozen or frozen chilled products can be shipped with container 10.

Figure 2:
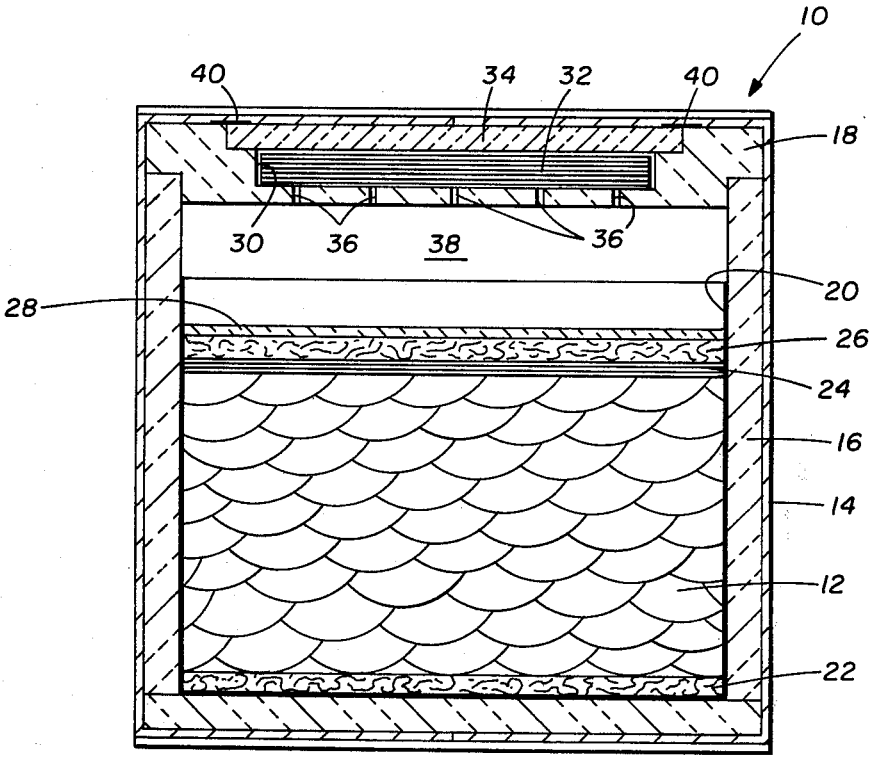
FIG. 2 is an enlarged vertical cross-sectional view of the shipping container.

Referring to FIG. 2 in conjunction with FIG. 1, container 10 includes an outer shell or carton 14 which encloses a box 16 and lid 18. Carton 14 can be formed of corrugated cardboard or other suitable material. Box 16 and lid 18 are of foam insulation material such as STYROFOAM brand material available from Dow Chemical. In accordance with the preferred embodiment, box 16 and lid 18 are constructed of STYROFOAM insulation with the lid being about 3.0 inches thick and the walls of the box being about 1.5 inches thick; however, it will be understood that the thickness and type of insulation can vary according to the ambient temperature, type of products being shipped and shipment time. In addition, it will be understood that box 16 can be of one-piece construction although the box is shown with separate bottom and side walls.

Box 16 and lid 18 thus define a closed storage chamber for products 12. If desired, a plastic liner 20 can be placed inside box 16 to provide a moisture, gas atmosphere and liquid barrier before introduction of product 12. Liner 20 can be of closed or open-top construction, and it will be understood that use of the liner is optical depending upon the type of products being shipped in container 10 and the construction of box 16. For example, liner 20 may not be necessary where box 16 is of one-piece construction.

Before introduction of products 12, an absorbent-type pad 22 is placed inside liner 20 on the bottom of box 16 or directly on the bottom of the box, as the case may be. The purpose of pad 22 is to absorb juices from products 12 and ice 24 to prevent soaking of the bottommost products which could cause early spoilage or discoloration during shipment. In accordance with the preferred embodiment of the invention, pad 22 is formed of absorbent material about 0.1 to 0.5 inches thick. For example, pad 22 can comprise paper wadding, sponge or other suitable material.

After placement of chilled products 12 on pad 22 within container 10, a layer of wet ice 24 is packed directly on the products. Ice 24 can be of shaved or flaked form, and it will be understood that the thickness of the layer will depend upon the ambient temperature, type of products being shipped and duration of shipment. As will be explained more fully hereinafter, the layer of ice 24 functions to insulate products 12 from the sub-freezing temperatures of the primary refrigerant and functions as the final refrigerant after exhaustion of the primary refrigerant.

A wet pad 26 is packed over the layer of ice 24. In the preferred embodiment, pad 26 is formed of absorbent material similar to that of pad 22, but which has been saturated with 0.5 to 3.0 or more pounds of cold ice water. Wet pad 26 provides moisture to the interior of container 10 and thus protects the products 12 from drying out in the presence of the primary refrigerant. Wet pad 26 acts as a heat sump to absorb and store some of the refrigeration from the expendible refrigerant in lid 18, as will be more explained below.

If desired, an additional layer of insulation 28 can be placed over wet pad 26 as shown; however, it will be understood that use of this insulation is optional. For example, insulation 28 can comprise a layer of foam material approximately 0.5 inches thick.

Still referring to FIG. 2 together with FIG. 1, lid 18 of container 10 includes a rectangular well or compartment 30 for receiving a quantity of expendible refrigerant 32. An openable cover 34 is provided in lid 18 for filling compartment 30. Solid carbon dioxide or dry ice in either block, snow or pellet form can be used for refrigerant 32. In accordance with the preferred embodiment of the invention, three to nine pounds of dry ice have been used; however, it will be understood that the quantity of dry ice depends upon the ambient temperature, type of products being shipped and shipment time. Dry ice is particularly advantageous by reason of its low temperature (−107° F.) and bacterialcidal properties.

A plurality of symmetrically arranged holes 36 are provided in lid 18 underneath compartment 30 for communication with the head space 38 within box 16. In accordance with the preferred embodiment, fourteen to sixteen holes 36 about 1/16th inch in diameter each have been provided in lid 18. As refrigerant 32 sublimates and expands, holes 36 act as valves allowing the cold gas to enter head space 38 and thereby maintain the chilled temperature of products 12 within container 10. Refrigerant 32 freezes wet pad 26 which provides moisture within container 10 and protects products 12 from the subfreezing temperatures generated by the refrigerant. If desired, strips of tape 40 can be used to seal around plug 34.

Having described the structure of the invention, the process accompanying use of such structure will now be described. The product to be shipped is initially chilled to the desired temperature, which is usually just above the freezing point. In the case of fresh fish, for example, the fish can be soaked in a solution of ice, water and salt to lower the temperature sufficiently so that the fish can be packed at about 32° F. Air, carbon dioxide or other types of gas can be bubbled through the brine solution to cause turbulence and thereby hasten the of heat transfer rate and thus chilling of the fish.

Before packing it may be desirable to enclose products 12 in a second liner (not shown) especially in case of red meat or other products which should not be exposed to excess moisture.

The chilled products 12 are then packed into container 10 between absorbent pad 22 and wet ice 24 and wet pad 26. Insulation 28 may be placed over wet pad 26 particularly if the chilled products 12 comprise red meat. A sufficient quantity of refrigerant 32 is then loaded into lid 18 either before or after the lid has been closed. After closure of carton 14, container 10 is ready for shipment.

As refrigerant 32 sublimates or changes directly from solid to gas form, cold gas passes through holes 36 into head space 38 to thereby cool box 16 and lid 18 of the container. The sublimated dry ice within head space 38 freezes wet pad 26 while the layer of ice 24 functions as an insulator between the frozen pad and chilled products 12. The primary refrigeration source is thus cold sublimated gas from refrigerant 32.

After refrigerant 32 has completely sublimated, frozen wet pad 26 and then ice 24 will serve as the secondary source of refrigeration. As ice 24 and wet pad 26 thaw, it will be appreciated that the chilled moisture therefrom will lend additional refrigeration as it flows over the products to the bottom of container 10 for absorption by pad 22. Most of the secondary refrigeration, however, will be provided by frozen wet pad 26 since very little melting of ice 24 will occur if shipment of container 10 is completed within the designed duration.

After exhaustion of refrigerant 32, container 10 can be recharged with a new supply of refrigerant through cover 34 without otherwise opening the container.

The following example is given to further illustrate the advantages of the present invention. Approximately 60 pounds of fish chilled to about 32° F. were packed into a container like that shown in FIGS. 1 and 2. The wet pad was saturated with about 2.5 pounds of water, and approximately eight pounds of dry ice and three pounds of wet ice are utilized. The dry ice required 36 to 48 hours to completely sublimate, depending upon the ambient temperature, and the frozen wet pad required an additional 12 to 14 hours to thaw. The average temperature of the fish was 32.3° F. for the first 60 hours, and no freezing of the fish occurred. In addition, the carbon dioxide atmosphere within the container reduced clouding of the fish eyes.

In view of the foregoing, it will be apparent that the present invention comprises an insulated container and process for shipping perishables incorporating numerous advantages over the prior art. The process and apparatus herein enable shipment of fresh fish, meat and other perishables under chilled conditions for relatively prolonged periods of time more economically. Other advantages will suggest themselves to those skilled in the art.

Although preferred embodiments of the invention have been illustrated in the accompanying Drawings and described in the foregoing Detailed Description, it will be understood that the invention is not limited to the embodiments disclosed, but is intended to embrace any alternatives, modifications, equivalents and rearrangements of elements falling within the spirit and scope of the invention as defined by the following claims.

I claim:

1. A process for packing perishables for shipment, comprising the steps of:

(a) chilling the perishables to a desired predetermined unfrozen temperature;

(b) placing the prechilled perishables on an absorbent pad within an insulated box;

(c) covering the prechilled perishables with a layer of ice;

(d) placing a wet pad on the layer of ice;

(e) closing the top end of said box with a lid positioned in spaced relationship with said wet pad in order to define a head space therebetween; and (f) connecting a compartment containing subliming expendable refrigerant in fluid communication with the head space of said box so that sublimated refrigerant can refrigerate said box and substantially freeze said wet pad, thereby maintaining the perishables in chilled but unfrozen condition during shipment.

2. The process of claim 1, where in step (a) the perishables are prechilled in unfrozen condition to a temperature near 32° F.

3. The process of claim 1, where in step (f) said expendable refrigerant comprises solid carbon dioxide.

4. The process of claim 1, where in step (f) the chamber containing said expendable refrigerant is located within said lid and is fluidly connected to the interior of said box by means of perforations in the lower surface of said lid.

5. A shipping container for chilled perishables, comprising:

a sidewall with top and bottom ends;

a bottom wall extending across and closing the bottom end of said sidewall;

said side and bottom walls defining an open-top box for receiving the chilled perishables to be shipped;

a removable lid for closing the top end of the box, said lid having top and bottom surfaces;

said lid including a chamber located between the top and bottom surfaces thereof for receiving a subliming expendable refrigerant;

said lid further including a plurality of spaced apart apertures extending through the lower surface thereof between the lid chamber and the interior of the container; and an openable cover in the top surface of said lid for loading subliming expendible refrigerant into the lid chamber.

6. The shipping container of claim 5, wherein said side and bottom walls are integrally joined together and are formed of foam-type material.

7. The shipping container of claim 5, wherein said lid and openable cover are formed of foam-type material.

8. The shipping container of claim 5, further including:

an absorbent pad positioned within the box on said bottom wall;

a layer of ice for covering the chilled perishables positioned on said absorbent pad; and a wet pad for covering said layer of ice.

9. The shipping container of claim 5, further including:

a liner disposed within the box defined by said side and bottom walls, said perishables being positioned within said liner.

10. A container for shipping chilled perishables, comprising:

an open-top box of insulative material defining a chamber for receiving the chilled perishables;

an absorbent pad located in the bottom of said box, said perishables being positioned on said absorbent pad;

a layer of ice covering the perishables;

a wet pad positioned on said layer of ice;

lid means including upper and lower surfaces for closing the top end of said box, the lower surface of said lid being positioned in spaced relationship with said wet pad to define a head space therebetween;

structure defining a compartment connected in fluid communication with said box between said lid and wet pad; and expendable refrigerant disposed in said compartment for sublimating into cold gas which enters the head space and refrigerates said wet pad and layer of ice in order to maintain said perishables in chilled condition.

11. The container of claim 10, wherein said box is comprised of foam-type material.

12. The container of claim 10, wherein said lid means is comprised of foam-type material.

13. The container of claim 10, further including:

a liner disposed inside said box, said absorbent pad and perishables being positioned within said liner.

14. The container of claim 10, wherein said expendable refrigerant comprises solid carbon dioxide.

15. The container of claim 10, wherein said compartment is located inside said lid means, and further including:

said lid means having a plurality of apertures extending between said compartment and the lower lid surface; and removable cover means in the upper lid surface for introducing said expendable refrigerant into said compartment.

16. A container for shipping chilled perishables, comprising:

an open-top box including side and bottom walls which define a chamber for receiving the chilled perishables to be shipped;

an absorbent pad positioned on the bottom wall of said box, said perishables being placed on said absorbent pad;

a layer of ice positioned on said perishables;

a wet pad positioned over said layer of ice;

a lid including top and bottom surfaces for closing the top end of said box;

said lid including a compartment therein and at least one passage extending through the bottom lid surface between the compartment and storage chamber, said bottom lid surface being positioned in spaced relationship with said wet pad to define a head space therebetween;

expendable refrigerant disposed in the compartment for sublimating into cold gas which flows through the passage and into the head space to refrigerate the storage chamber and substantially freeze said wet pad, thereby maintaining said perishables in chilled condition; and a removable cover in the top surface of said lid for loading said expendable refrigerant into the lid compartment.

17. The container of claim 16, wherein said box, lid and cover are comprised of foam-type material.

18. The container of claim 16, wherein said expendable refrigerant comprises solid carbon dioxide.

19. The container of claim 16 further including:

a liner disposed in said box, said absorbent pad and perishables being positioned within said liner.

20. The container of claim 16, further including:

a layer of insulation positioned over said wet pad.

* * * * *

UNITED STATES PATENT AND TRADEMARK OFFICE

CERTIFICATE OF CORRECTION

PATENT NO. : 4,294,079

DATED : October 13, 1981

INVENTOR(S) : ERNEST J. BENSON

It is certified that error appears in the above-identified patent and that said Letters Patent are hereby corrected as shown below:

Column 2, line 14, "utilizes" should be --utilize--

Column 3, line 15, "optical" should be --optional--.

Signed and Sealed this

*Fifth* Day of *January 1982*

[SEAL]

*Attest:*

GERALD J. MOSSINGHOFF

*Attesting Officer*

*Commissioner of Patents and Trademarks*